United States Patent [19]

Whitwam et al.

[11] Patent Number: 4,570,895

[45] Date of Patent: Feb. 18, 1986

[54] CHAIR CONTROL TENSION ADJUSTMENT ASSEMBLY

[75] Inventors: Ronald L. Whitwam, Caledonia; Charles C. Pergler, Grand Rapids, both of Mich.

[73] Assignee: Steelcase, Inc., Grand Rapids, Mich.

[21] Appl. No.: 384,647

[22] Filed: Jun. 3, 1982

Related U.S. Application Data

[63] Continuation of Ser. No. 145,440, May 1, 1980.

[51] Int. Cl.[4] ..... F16M 13/00

[52] U.S. Cl. ..... 248/575; 74/547

[58] Field of Search ..... 248/575, 576, 577; 297/304, 306; 74/543, 544, 545, 546, 547

[56] References Cited

U.S. PATENT DOCUMENTS

| | | | |
|---|---|---|---|
| 1,247,911 | 11/1917 | Walkup | 74/547 |
| 2,572,444 | 10/1951 | Carden | 74/574 X |
| 2,696,128 | 12/1954 | Runke et al. | 74/543 |
| 3,059,890 | 10/1962 | Radke et al. | 248/575 |
| 3,536,299 | 10/1970 | McCloud | 74/547 X |
| 4,214,726 | 7/1980 | Karrip et al. | 248/575 |

*Primary Examiner*—William H. Schultz

*Attorney, Agent, or Firm*—Price, Heneveld, Huizenga & Cooper

[57] ABSTRACT

The specification discloses a chair control in which the pretension on the bias means can be adjusted by means of a bolt having a hollow shank with a retractable lever normally stored therein. There is a slot extending from the opening of the hollow shank down one side which can be engaged by said lever when the lever is retracted from the hollow shank and pivoted to one side. There is a retainer cap on the end of the hollow shank which includes an inwardly projecting annular lip which engages an annular rib on the lever to normally hold the lever in its stored position within the hollow shank of the bolt, even though the bolt is oriented upside down when the chair control is mounted on a chair. The lip is yieldable so that one can grasp the lever and pull it out past the lip when one wants to pivot it to one side and into the slot and thereafter rotate the bolt by applying a force to the lever.

21 Claims, 10 Drawing Figures

CHAIR CONTROL TENSION ADJUSTMENT ASSEMBLY

BACKGROUND OF THE INVENTION

The present invention relates to chair controls. Chair controls are mechanisms which control the rate of tilting of a chair when a user leans back in the chair. They typically comprise a stationary member adapted for mounting on a pedestal base, at least one tiltable member pivotally mounted relative to the stationary member and an energy storing source or bias means operably mounted between the tiltable member and the stationary member. A chair back or chair seat is typically joined to the tiltable member. As one leans back in the chair, the tiltable member pivots relative to the stationary member and the bias means controls the rate of tilting. When one stops leaning back in the chair, the bias means returns the tiltable member to its normal position.

Usually, a chair control includes some means for adjusting the pretension of the bias means. The greater the pretension on the bias means, the more force it takes to lean back in a chair to which the chair control is mounted. Usually, this adjustment means comprises a threaded bolt with a hand wheel on one end. The threaded bolt threads into a threaded member which is operably attached to the bias means. When one turns the bolt using the hand wheel, one tightens or loosens the tension on the bias means. Examples of such devices include the following patents to Doerner, U.S. Pat. Nos. 3,339,973, 3,601,444 and 3,603,640, issuing Sept. 5, 1967, Aug. 24, 1971 and Sept. 7, 1971 respectively.

In his U.S. Pat. No. 3,881,772, Mohrman associated with a hand wheel by providing a conventional bolt with a slotted head for receiving a screw driver. This mechanism is, however, inconvenient. Tilting chairs to which chair controls are usually applied are most often found in offices. Screw drivers most often are not found in offices.

SUMMARY OF THE INVENTION

The present invention comprises a chair control on which the unsightly adjustment wheel has been eliminated without creating the need for extraneous tools. The chair control of the present invention includes a threaded bolt with a hollow shank. A lever is telescopically received within the hollow shank and there are means on the bolt engagable by the lever when it is retracted from the hollow shank and pivoted to a generally lateral position with respect to the bolt such that by applying a force to the lever, one can rotate the bolt and thread it upwardly or downwardly. Retainer means on the bolt normally hold the lever in a stored position within the hollow shank, but the retainer means are adapted to yield upon application of a manual force to allow the lever to be withdrawn from the hollow shank and rotated to its lateral position.

These and other objects, advantages and features of the present invention will be more fully understood and appreciated by reference to the written specification and appended drawings.

DESCRIPTION OF THE PREFERRED EMBODIMENT

Figure 1:
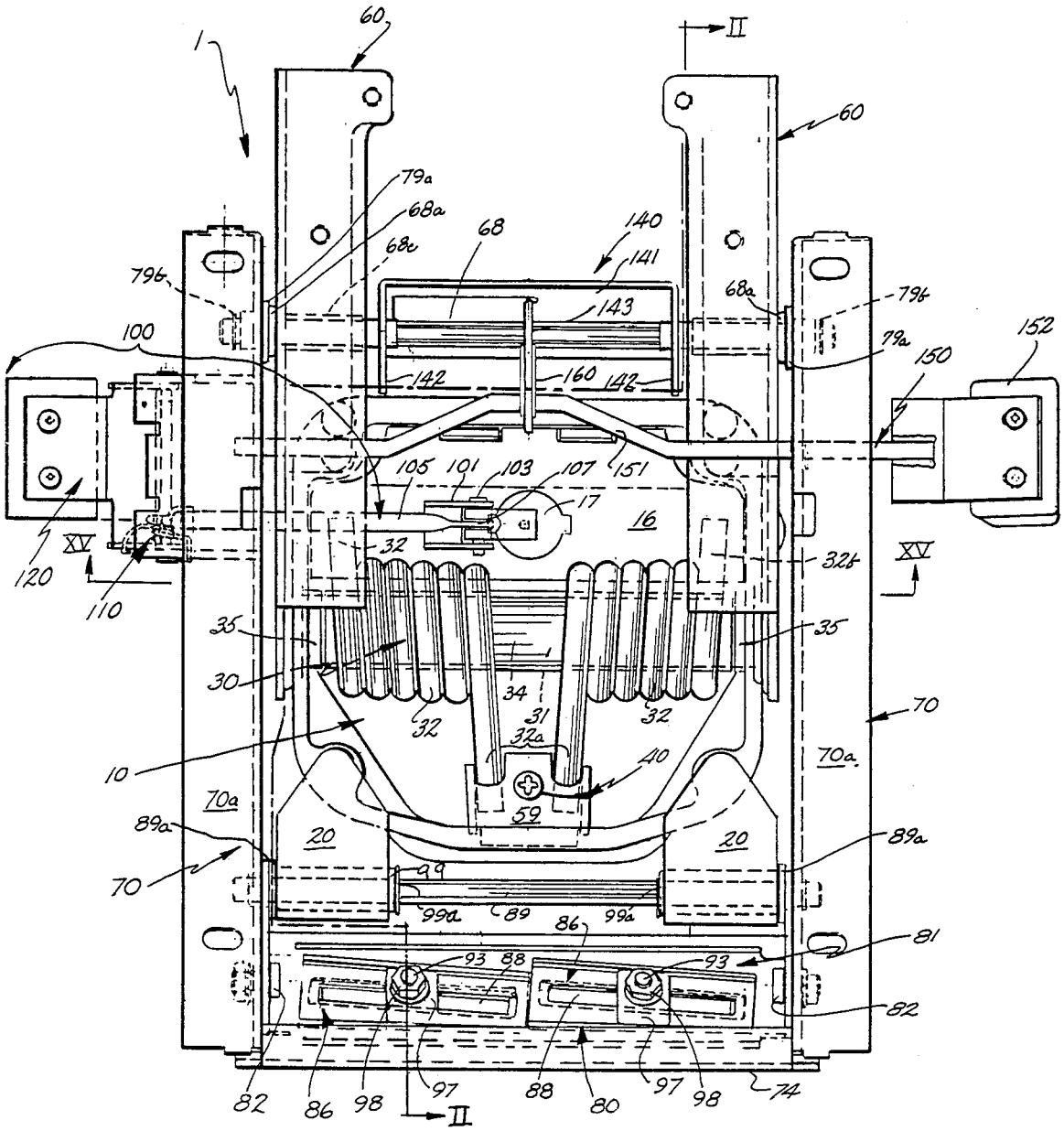
FIG. 1 is a plan view of a chair control made in accordance with the present invention.
Figure 4:
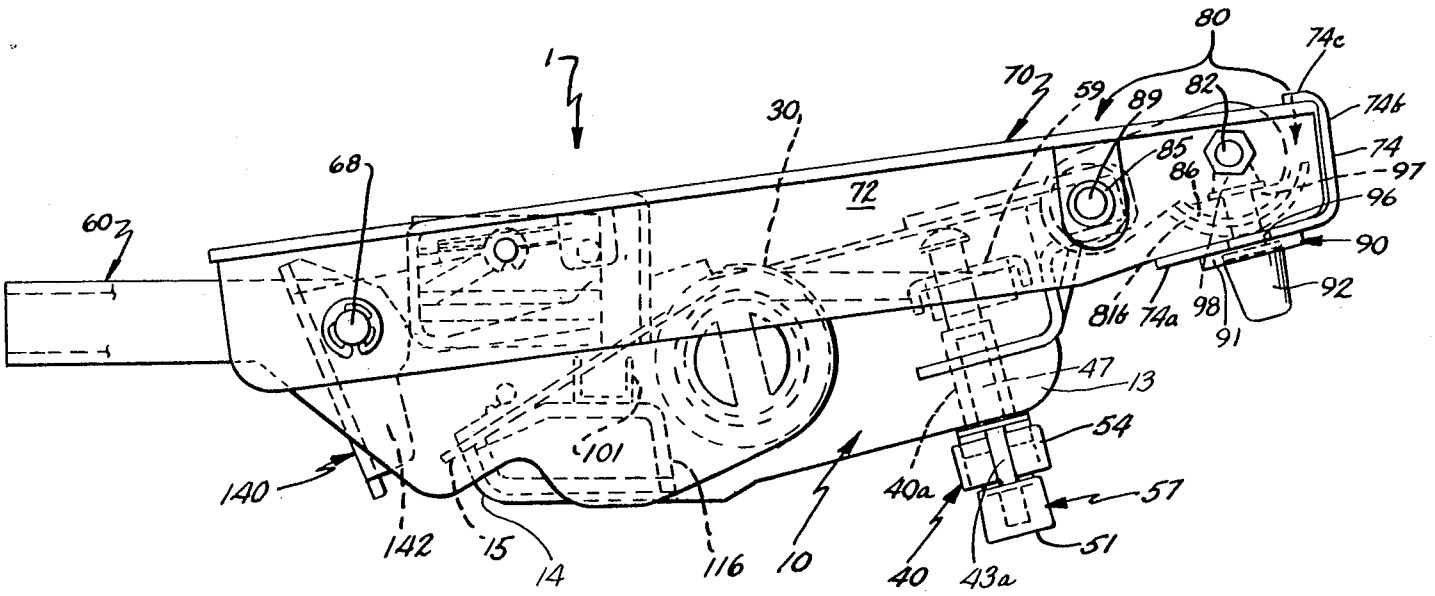
FIG. 4 is a side elevational view of the chair control with some of the internal components being shown in hidden lines.

Chair control 1 comprises a stationary control housing 10 which houses a bias means 30 (FIGS. 1 and 4). The degree of pretension on bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount could be direct, but as shown it is through a seat adjustment assembly 80 which is the subject of another invention. Other features are also shown in the drawing which are not described in detail herein since they do not form part of the instant invention.

As described above and as shown, control 1 has two tiltable members which are interconnected and tilt together but at different rates. These are seat support stretcher 70 and back support arms 60. However for purposes of the present invention, there might be only one of these or they might be interconnected. It is only important that there be a tiltable member joined to stationary member 10 through a bias means 30.

Further, a slidable interconnection between seat support 70 and stationary housing 10 is described and shown. However, that is not important to the invention claimed herein.

Stationary control housing 10 is a stamped or otherwise formed metal dish having a bottom wall 11, side walls 12, a front wall 13 and and rear wall 14 (FIGS. 1 and 4). A lip 15 extends around the upper periphery. There is an aperture in bottom 11 through which the upper end of spindle 2 extends. A spindle mounting plate 16 is welded to the inside of housing 10 and includes an aperture 17*a* therein to also receive the upper end of a chair base column (FIGS. 1 and 2).

Bias means 30 comprises a torsional coil spring arrangement. An arbor 31 which is generally circular in cross sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof. The rear ends 32*b* of springs 32 are captured under the chair back support arms 60. Tension adjustment is achieved by tightening or loosening tension bolt 40 in retainer nut 59. Basically, tension adjustment bolt assembly 40 comprises a bolt 40*a* having a hollow shank normally housing a lever 47. One can grasp gripping cap 51, retract lever 47, pivot it to one side into a slot 43*a* and rotate it to thread bolt 40*a* up or down in retainer 59.

Figure 2:
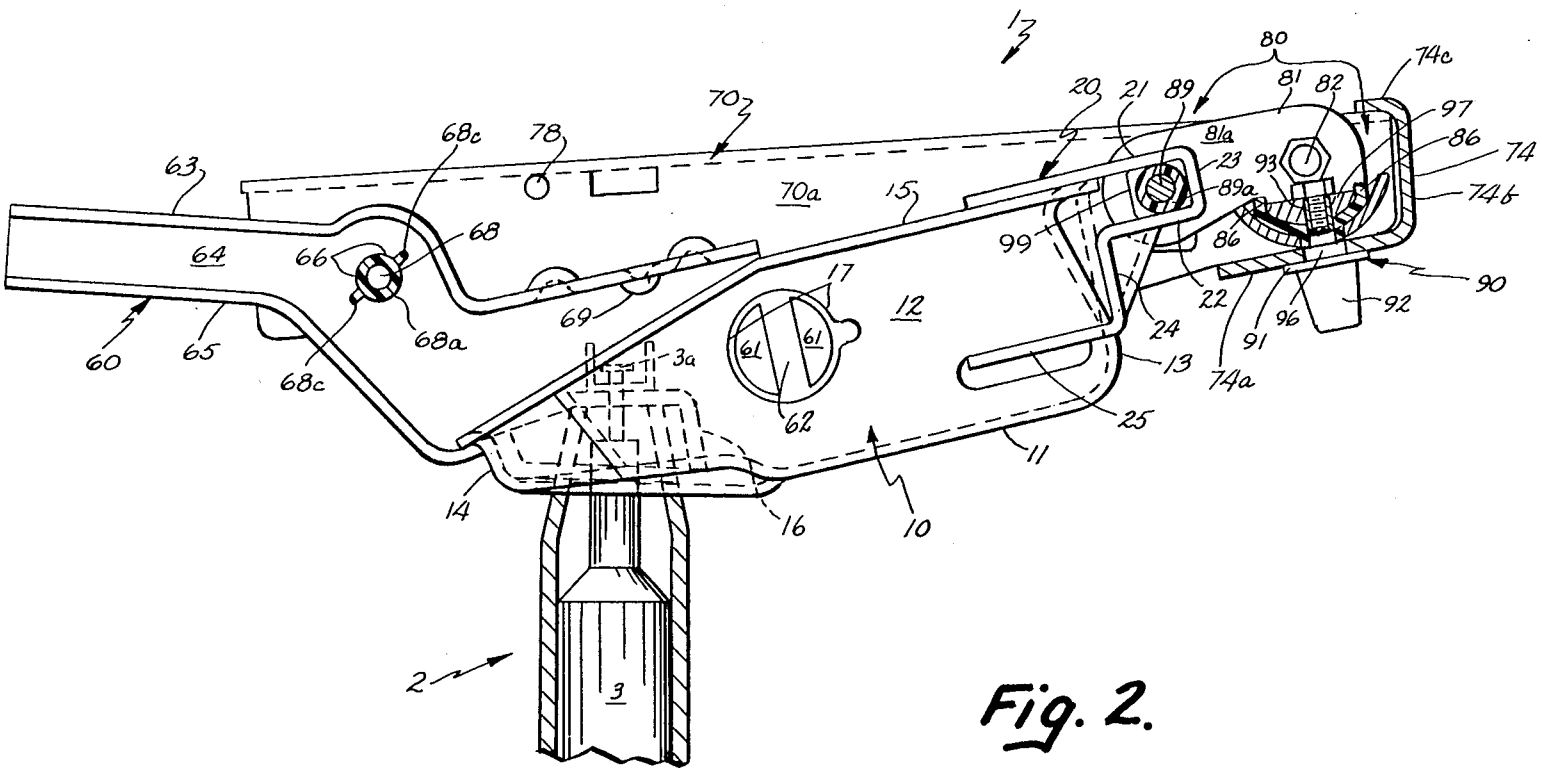
FIG. 2 is a fragmentary cross-sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
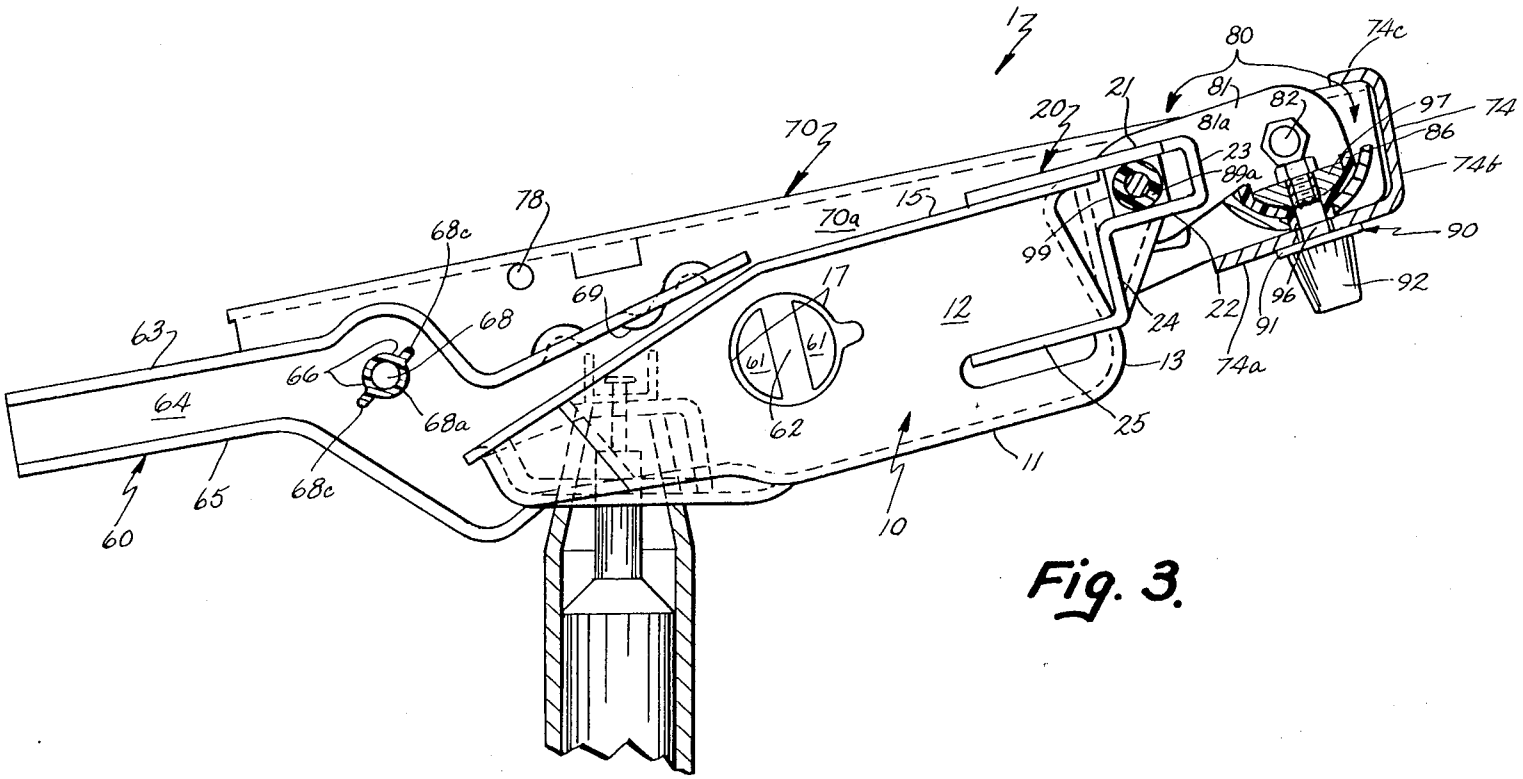
FIG. 3 is the same view as FIG. 2, but with the chair control in the position which it assumes when a person leans back in a chair to which the chair control is attached.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 60 is visible through the hole 17 in the side of stationary housing 10 in FIG. 2. There are two semi-circles 61 spaced by a bridge 62. The ends of arbor 30 are slotted so that they fit into the semi-circles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs.

Located about midway along the length of each chair back support arm 60 is a hole 66 which is adapted to receive the rear axle 68 and suitable bearing 68*a*. It is on the rear axle 68 that the rear of chair seat support assembly 70 is pivotally carried.

The chair seat support assembly 70 comprises a pair of spaced stretchers 70*a* joined at the front by front piece 74 (FIGS. 1 and 2). Located towards the rear of each side wall 72 of each stretcher 70*a* is a rear axle receiving hole 79 which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

Figure 5:
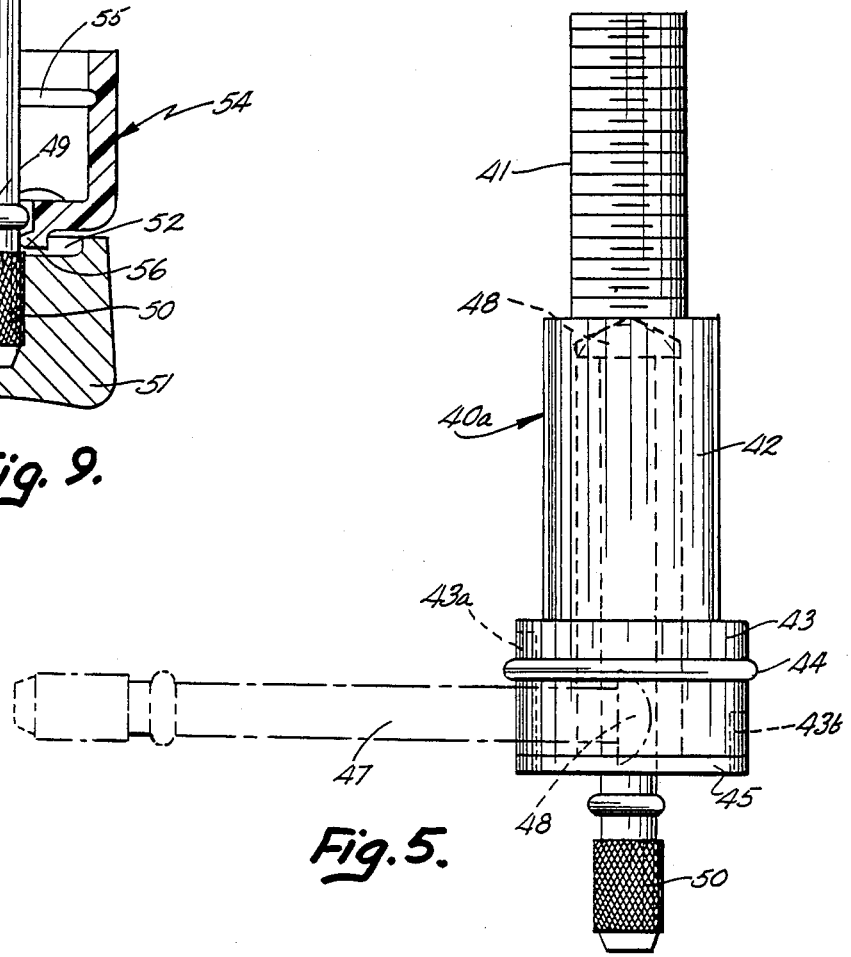
FIG. 5 is an elevational view of portions of the tension bolt assembly 40.
Figure 6:
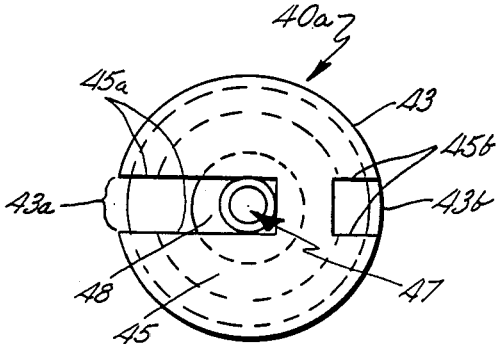
FIG. 6 is a top plan view of that shown in FIG. 5.

Tension adjustment assembly 40 comprises a threaded bolt assembly 40*a* which extends through the bottom of stationary housing 10 and is threaded into a threaded retainer nut 59 (FIG. 4). Referring to FIG. 5, it will be seen that adjustment bolt 40*a* comprises a threaded end 41 which projects from a hollow tubular shank 42. There is an enlarged head 43 at the end of hollow shank 42 and there are a pair of spaced slots 43*a* and 43*b* on opposite sides of head 43 (FIG. 6).

Positioned within hollow shank 42 is an elongated lever 47 having an enlarged retainer head 48. Lever 47 is free to slide in and out of hollow shank 42 and can be extracted from its position as shown in solid and hidden lines in FIG. 5 to the lateral position shown in phantom lines in FIG. 5. In the lateral position, lever 47 is seated within and extends through the large slot 43*a* on one side of head 43.

In order to prevent lever 47 from falling completely out of the hollow interior of shank 42, a slotted washer 45 is welded to the open top of head 43. It includes a relatively long slot 45*a* which extends from beyond its center to one edge and which, in assembly, is aligned with slot 43*a* in the side of head 43. Another shorter slot 45*b* extends from the opposite side of washer 45 and aligns with slot 43*b* in head 43. It can be seen that slot 43*a* allows one to pull lever 47 into an extended position and fold it over so that it extends through slot 43*a*, but does not allow the enlarged head 48 to be retracted from the assembly since slot 45*a* is narrower than the width of enlarged head 48.

Figure 9:
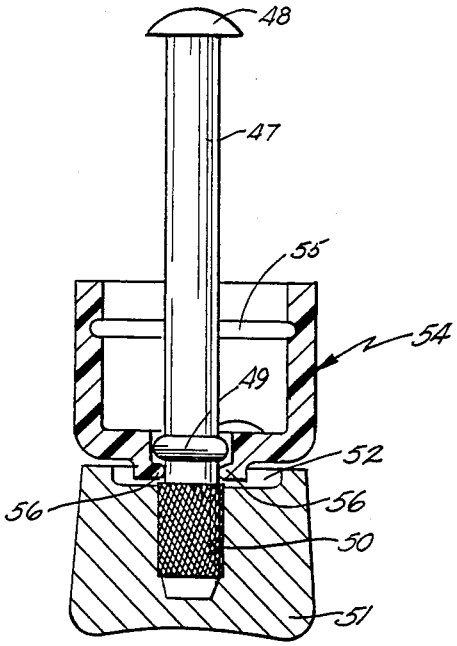
FIG. 9 is a cross sectional view of the adjustment cap assembled with the actuating lever 47.
Figure 7:
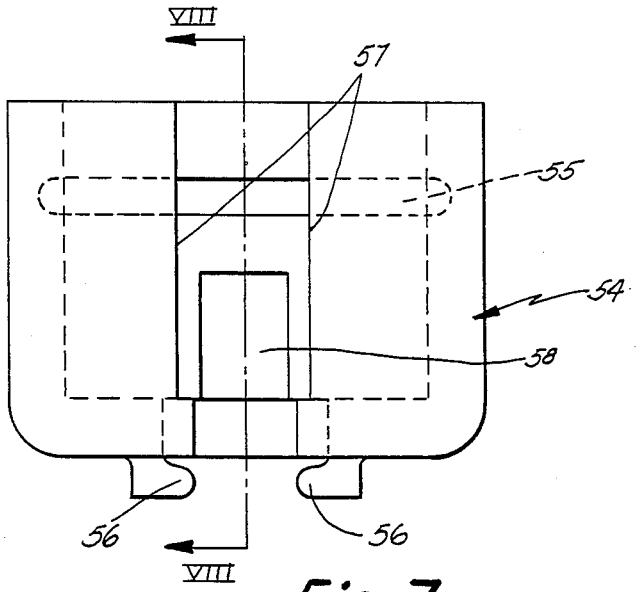
FIG. 7 is an elevational view of the adjustment cap.
Figure 8:
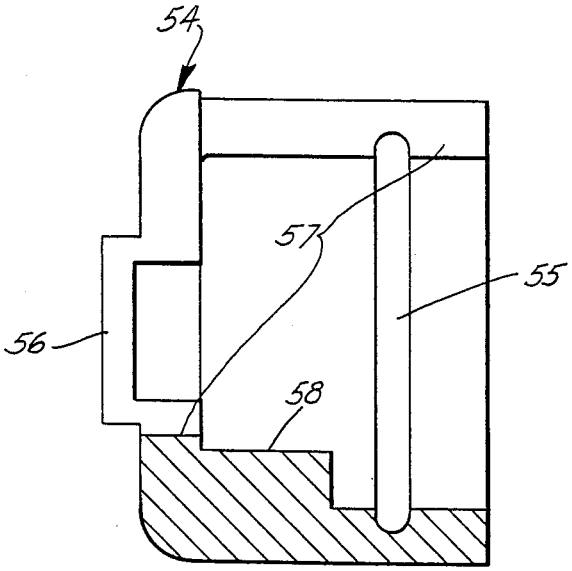
FIG. 8 is a cross sectional view of the adjustment cap taken along plane VIII—VIII of FIG. 7.

Enlarged head 43 of bolt 40*a* includes an annular rib 44 projecting from the exterior surface thereof. This facilitates mounting a plastic cap 54 over head 43 (FIGS. 7, 8 and 9). Cap 54 includes an inner annular groove 55 which seats over projecting annular rib 44 and thereby holds cap 54 in position on enlarged head 43.

Cap 54 also includes an enlarged slot 57 which extends completely up one side and through the top of the cap all the way beyond its center and almost to the opposite side (FIGS. 7 and 8). Slot 57 is intended to line up with slots 43*a* and 45*a* so that the presence of cap 54 on head 43 does not hinder the action of lever 47 as illustrated in FIG. 5.

In order to align slot 57 properly, cap 54 includes an inwardly projecting tab 58. Tab 58 is located directly opposite slot 57 and seats within slots 45*b* and 43*b* on head 43 to thereby insure that slot 57 will be properly aligned with slots 43*a* and 45*a*.

Other than aesthetics, the primary purposes of cap 54 is to retain lever 47 in its normally stored condition as illustrated in FIGS. 4 and 5. Lever 47 includes its own annular rib 49 near its end opposite retainer head 48. Cap 54 includes an annular lip 56 extending around a top central opening. Top lip 56 and annular rib 49 are dimensioned such that annular rib 49 can be forced past lip 56 in either direction, but the fit is a snug one such that absent application of force, annular rib 49 will be retained behind lip 56 to thereby hold lever 47 in its up position as indicated in FIG. 4 and FIG. 9.

Lever 47 includes a knurled end 50. This receives a plasatic gripping head 51 which has a hollow core to fit snuggly over knurled end 50. The bottom (or top depending on your point of view) of gripping head 51 is hollowed out to define a shallow recess 52. The purpose of recess 52 is to fit over and cover the downwardly protruding lips 56 of cap 54 when lever 47 is seated in its normally stored position as illustrated in FIG. 9. The reason lips 56 project downwardly below the level of the rest of the body of cap 54 and then inwardly is that such positioning renders them somewhat more flexible, enabling them to be dimensioned more snuggly around the main body of lever 47 and still allows them to be flexed to one side as annular rib 49 passes.

The threaded end 41 of bolt 40*a* is threaded into a threaded opening in retainer nut 59. When one wants to adjust the pretension of bias means 30, one grips gripping head 51, pulls lever 47 downwardly and pivots lever 47 to one side until it is located so as to pass through slot 43*a* (FIG. 5). One then applies a force to the end of lever 47 and thereby rotates adjustment bolt 40*a*, causing it to thread upwardly or downwardly in retainer nut 59.

Figure 10:
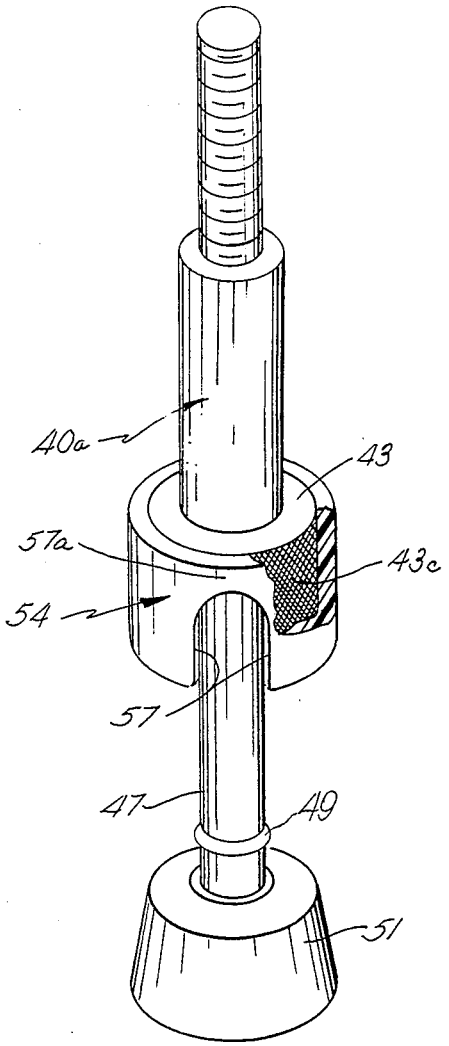
FIG. 10 shows an alternative cap and means for securing it to bolt 40*a*, with a portion of the cap broken away.

FIG. 10 discloses an alternative and indeed most preferred means for securing cap 54 to bolt 40*a*. The differences in the FIG. 10 embodiment over that described above are:

1. elimination of rib 44 and groove 55;
2. addition of a knurled surface 43*c* on head 43; and
3. closing of slot 57 in cap 54 at the base thereof by a bridge 57*a* of plastic material.

With slot 57 closed by bridge 57*a*, cap 54 can now be force fitted onto head 43. Knurled surface 43*a* digs into the interior plastic surface of cap 54 and holds cap 54 in place on head 43. This eliminates the need for rib 44 and groove 55.

If one wishes to adjust the pretension of bias unit 30, one reaches under the front of chair control 1 and grasps button 51, pulls lever 47 down past lip 56 and pivots lever 47 into slot 43*a* in the side of bolt 40*a*. By then rotating lever 47, one threads bolt 40*a* in threaded retainer 59. This pulls down on, or alternatively eases off on, the ends 32*a* of coil springs 32 and thereby changes the tension thereon.

Of course, it is understood that the above is merely a preferred embodiment of the invention and that various changes and alterations can be made without departing from the spirit and broader aspects thereof as more particularly defined in the appended claims.

The embodiments of the invention in which an exclusive property or privilege is claimed are defined as follows:

1. A chair control having a stationary member, a tiltable member pivotally connected thereto, bias means operably connected to both to control the rate of tilt and to return the tiltable member to its normal position, a threaded member operably connected to the bias means and a bolt threaded in the threaded member whereby tightening or loosening said bolt changes the pretension on the bias means, the improvement in said chair control comprising: said bolt having a hollow shank with an open end, a lever being telescopically received in said hollow shank and projecting from said open end, means on said bolt engagable by said lever when said lever is retracted from said hollow shank and pivoted to a generally lateral position with respect to said bolt; means preventing said lever from being completely removed and separated from said bolt when it is retracted from said hollow shank; retainer means on said bolt normally holding said lever in a stored position within said hollow shank, said retainer means being adapted to yield upon application of manual force to allow said lever to be withdrawn from said hollow shank and pivoted to its lateral position engaging said engagable means on said bolt, said retainer means comprising a retainer cap seated on the end of said hollow shank and including an aperture therein through which said lever passes.

2. The chair control of claim 1 in which said retainer cap is a molded plastic retainer cap and said plastic cap includes generally annular inwardly projecting retainer lip means extending at least partially around said aperture in said retainer cap and which engage at least a portion of said lever to normally hold said lever in said stored position within said hollow shank, but which yields when one pulls on said lever to allow said lever to be withdrawn from said hollow shank and rotated to its generally lateral position with respect to said bolt.

3. The chair control of claim 2 in which said lever includes an annular projecting rib towards that end thereof which is located near said open end in said hollow shank when said lever is in its normally stored position within said hollow shank, said annular rib being engaged by said annular inwardly projecting lip of said retainer cap when said lever is in its normally stored position within said hollow shank.

4. The chair control of claim 3 in which said annular inwardly projecting lip means protrudes downwardly from said cap, with respect to the position of said cap when said chair control is installed on a chair, and then protrudes inwardly whereby said annular lip is rendered more yieldable when one pulls said annular rib of said lever past said lip.

5. The chair control of claim 4 in which said lever includes a molded plastic gripping cap on that end thereof which is located outside of said hollow shank of said bolt whereby one can readily grip said lever and manipulate it.

6. The chair control of claim 5 in which said gripping cap includes a recess in that surface thereof which is oriented towards said retainer cap, said recess being adapted to receive said protruding lip and conceal same from view when said lever is in its normally stored position within said hollow shank of said bolt.

7. The chair control of claim 5 in which said lever includes a knurled surface near that end thereof which is positioned outside of said hollow shank, said gripping cap being seated on and held in place by said knurled end.

8. The chair control of claim 1, 2, 3, 4, 5, 6 or 7 in which said hollow shank of said bolt includes an exterior projecting annular rib and said retainer cap includes an interior annular groove, said interior annular groove seating over said exterior annular rib of said shank when said retainer cap is fitted onto said shank.

9. A chair control having a stationary member, a tiltable member pivotally connected thereto, bias means operably connected to both to control the rate of tilt and to return the tiltable member to its normal position, a threaded member operably connected to the bias means and a bolt threaded in the threaded member whereby tightening or loosening said bolt changes the pretension on the bias means, the improvement in said chair control comprising: said bolt having a hollow shank with an open end, a lever being telescopically received in said hollow shank and projecting from said open end, means on said bolt engagable by said lever when said lever is retracted from said hollow shank and pivoted to a generally lateral position with respect to said bolt; means preventing said lever from being completely removed and separated from said bolt when it is retracted from said hollow shank; retainer means on said bolt normally holding said lever in a stored position within said hollow shank, said retainer means being adapted to yield upon application of manual force to allow said lever to be withdrawn from said hollow shank and pivoted to its lateral position engaging said engagable means on said bolt; said means engagable by said lever when said lever is rotated to a lateral position with respect to said bolt comprising a longitudinal slot extending from said open end in said hollow shank down the side of said shank; and said retainer means comprising a molded plastic retainer cap seated on the end of said hollow shank and including an aperture therein through which said lever passes.

10. The chair control of claim 9 in which said retainer cap includes an elongated slot extending from its aperture down at least a portion the side thereof, which slot is aligned with said slot in said hollow shank of said bolt.

11. The chair control of claim 10 in which said hollow shank of said bolt includes a second slot generally in one side thereof, but not communicating with said open end of said hollow shank, said retainer cap including an inwardly projecting tab which seats in said second slot to properly orient said retainer cap on said hollow shank with said slot of said retainer cap in alignment with said first slot in said hollow shank.

12. The chair control of claim 11 in which said second slot in said hollow shank extends a short distance from the edge of said retainer washer towards the opening thereof, but does not communicate with said opening of said washer.

13. The chair control of claim 9 in which said hollow shank of said bolt includes an exterior knurled surface, fitting over and being seated on said knurled surface.

14. The chair control of claim 9 in which said hollow shank of said bolt includes an exterior projecting annular rib and said retainer cap includes an interior annular groove, said interior annular groove seating over said exterior annular rib of said shank when said retainer cap is fitted onto said shank.

15. A chair control having a stationary member, a tiltable member pivotally connected thereto, bias means operably connected to both to control the rate of tilt and to return the tiltable member to its normal position, a threaded member operably connected to the bias means and a bolt threaded in the threaded member whereby tightening or loosening said bolt changes the pretension on the bias means, the improvement in said chair control comprising: said bolt having a hollow shank with an open end, a lever being telescopically received in said hollow shank and projecting from said open end, means on said bolt engagable by said lever when said lever is retracted from said hollow shank and pivoted to a generally lateral position with respect to said bolt; means preventing said lever from being completely removed and separated from said bolt when it is retracted from said hollow shank; retainer means on said bolt normally holding said lever in a stored position within said hollow shank, said retainer means being adapted to yield upon application of manual force to allow said lever to be withdrawn from said hollow shank and pivoted to its lateral position engaging said engagable means on said bolt; and said retainer means comprising a molded plastic retainer cap seated on the end of said hollow shank and including an aperture therein through which said lever passes; said means engagable by said lever when said lever is rotated to a lateral position with respect to said bolt comprising a longitudinal slot extending from said open end in said hollow shank down the side of said shank; said retainer cap including an elongated slot extending from its aperture all the way down the side thereof, which slot is aligned with said slot in said hollow shank of said bolt.

16. The chair control of claim 15 in which said lever includes a retainer head on that end thereof which is located within said hollow shank, said retainer head having a cross section which is enlarged with respect to the rest of the cross section of said lever; said bolt including a slotted retainer washer secured at and defining said open end of said hollow shank, said washer allowing said lever to be moved in and out of said hollow shank, but having an opening sufficiently small that it will not allow said retainer head to pass, the slot of said washer comprising a portion of said slot which extends from said open end of said hollow shank down the side of said hollow shank.

17. The chair control of claim 16 in which; said hollow shank of said bolt includes a second slot generally in one side thereof, but not communicating with said open end of said hollow shank, said retainer cap including an inwardly projecting tab which seats in said second slot to properly orient said slot of said retainer cap in alignment with said first slot in said hollow shank; said second slot in said slot hollow shank extending a short distance from the edge of said retainer washer towards the opening thereof, but not communicating with said opening of said washer.

18. The chair control of claim 15, 16 or 17 in which said plastic cap includes generally annular inwardly projecting retainer lip means extending at least partially around said aperture in said retainer cap and which engage at least a portion of said lever to normally hold said lever in said storage position within said hollow shank, but which yield when one pulls on said lever to allow said lever to be withdrawn from said hollow shank and rotated to its generally lateral position with respect to said bolt; said lever including an annular projecting rib located towards that end thereof which is near said open end in said hollow shank when said lever is in its normally stored position within said hollow shank, said annular rib being engaged to by said annular inwardly projecting lip of said retainer cap when said lever is in its normally stored position within said hollow shank.

19. The chair control of claim 18 in which: said annular inwardly projecting lip means protrudes downwardly from said cap, with respect to the position of said cap when said chair control is installed on a chair, and then protrudes inwardly whereby said annular lip means is rendered more yieldable when one pulls said annular rib of said lever past said lip means; said lever including a molded plastic gripping cap on that end thereof which is located outside of said hollow shank of said bolt whereby one can readily grip said lever and manipulate it; said gripping cap including a recess in that surface thereof which is oriented towards said retainer cap, said recess being adapted to receive said protruding lip means and conceal same from view when said lever is in its normally stored position within said hollow shank of said bolt.

20. The chair control of claim 18 in which said hollow shank of said bolt includes an exterior knurled surface, said retainer cap fitting over and being seated on said knurled surface.

21. The chair control of claim 18 in which said hollow shank of said bolt includes an exterior projecting annular rib and said retainer cap interior projecting annular rib and said retainer cap includes an interior annular groove, said interior annular groove seating over said exterior annular rib of said shank when said retainer cap is fitted onto said shank.

* * * * *

UNITED STATES PATENT AND TRADEMARK OFFICE

CERTIFICATE OF CORRECTION

PATENT NO. : 4,570,895

DATED : February 18, 1986

INVENTOR(S) : Ronald L. Whitwam and Charles C. Pergler

It is certified that error appears in the above-identified patent and that said Letters Patent is hereby corrected as shown below:

Column 1, line 7:
Insert before the first sentence --This is a continuation of application Serial No. 145,440, filed May 1, 1980.--

Column 4, line 50:
"plasatic" should be --plastic--

Column 4, line 66:
After "and" insert --then--

Signed and Sealed this

*Thirtieth* Day of *September 1986*

[SEAL]

*Attest:*

DONALD J. QUIGG

*Attesting Officer*

*Commissioner of Patents and Trademarks*